US007818947B2

(12) United States Patent
Kim

(10) Patent No.: US 7,818,947 B2
(45) Date of Patent: Oct. 26, 2010

(54) AUTOMATIC MEDICINE PACKING MACHINE WITH CLEANING DEVICE

(75) Inventor: Jun Ho Kim, Daegu (KR)

(73) Assignee: JVM Co., Ltd., Daegu (KR)

( * ) Notice: Subject to any disclaimer, the term of this patent is extended or adjusted under 35 U.S.C. 154(b) by 0 days.

(21) Appl. No.: 12/545,687

(22) Filed: Aug. 21, 2009

(65) Prior Publication Data

US 2010/0043351 A1 Feb. 25, 2010

(30) Foreign Application Priority Data

Aug. 21, 2008 (KR) ..... 10-2008-0081681

(51) Int. Cl.
*B65B 1/04* (2006.01)
*B65B 65/08* (2006.01)

(52) U.S. Cl. ..... 53/167; 53/237; 53/247

(58) Field of Classification Search ..... 53/510, 53/111 R, 167, 235, 237, 247; 222/148, 222/150

See application file for complete search history.

(56) References Cited

U.S. PATENT DOCUMENTS

| | | | | | |
|---|---|---|---|---|---|
| 2,538,441 | A | * | 1/1951 | Carter | 141/7 |
| 3,376,753 | A | * | 4/1968 | Pitkin et al. | 73/866 |
| 4,184,306 | A | * | 1/1980 | Grasson | 53/240 |
| 4,421,185 | A | | 12/1983 | Koto et al. | 177/25 |
| 4,526,214 | A | * | 7/1985 | McGregor | 141/59 |
| 4,531,598 | A | * | 7/1985 | Kitagawa | 177/128 |
| 4,704,845 | A | * | 11/1987 | Bruno | 53/482 |
| 4,790,118 | A | | 12/1988 | Chilcoate | 53/411 |
| 4,811,764 | A | * | 3/1989 | McLaughlin | 141/98 |
| 5,231,804 | A | * | 8/1993 | Abbott | 451/76 |
| 5,348,061 | A | | 9/1994 | Riley et al. | 141/104 |
| 5,468,110 | A | | 11/1995 | McDonald et al. | 414/273 |
| 5,597,995 | A | | 1/1997 | Williams et al. | 235/375 |
| 5,709,063 | A | | 1/1998 | Yuyama et al. | 53/154 |
| 5,713,487 | A | | 2/1998 | Coughlin | 221/2 |
| 5,771,657 | A | | 6/1998 | Lasher et al. | 53/55 |
| 5,787,678 | A | | 8/1998 | Koike et al. | 53/154 |
| 5,880,443 | A | | 3/1999 | McDonald et al. | 235/375 |
| 5,930,145 | A | | 7/1999 | Yuyama et al. | 364/479.01 |
| 5,945,651 | A | | 8/1999 | Chorosinski et al. | 235/375 |
| 6,006,946 | A | | 12/1999 | Williams et al. | 221/9 |

(Continued)

FOREIGN PATENT DOCUMENTS

| | | |
|---|---|---|
| JP | 8020438 A | 1/1996 |
| JP | 2004345837 | 12/2004 |
| JP | 2006109859 | 4/2006 |
| WO | 0174666 A1 | 10/2001 |

*Primary Examiner*—Paul R Durand
(74) *Attorney, Agent, or Firm*—Seed IP Law Group PLLC

(57) ABSTRACT

Disclosed is an automatic medicine packing machine having a cleaning device for automatically cleaning dust generated in the packing machine while packing successively various medicines dose by dose. An automatic medicine packing machine includes a plurality of cassettes arranged in an upper portion of a body to receive medicines of various sizes and shapes, a hopper assembly arranged in a lower portion of the body to collect medicines discharged from the cassettes, a hopper mounting unit for mounting the hopper assembly to a lower portion of a frame of the body to be openable, a packing device for packing the medicines collected by the hopper assembly, and a hopper cleaning device for sucking dust generated from the hopper assembly during a medicine packing process to clean an interior of the hopper assembly.

17 Claims, 14 Drawing Sheets

U.S. PATENT DOCUMENTS

| | | | | |
|---|---|---|---|---|
| 6,058,557 | A * | 5/2000 | Berndt | 15/314 |
| 6,079,592 | A | 6/2000 | Hennessy et al. | 221/206 |
| 6,112,502 | A | 9/2000 | Frederick et al. | 53/411 |
| 6,216,418 | B1 | 4/2001 | Kim | 53/131.5 |
| 6,481,180 | B1 | 11/2002 | Takahashi et al. | 53/237 |
| 6,604,019 | B2 | 8/2003 | Ahlin et al. | 700/231 |
| 6,691,490 | B1 | 2/2004 | Yuyama et al. | 53/131.4 |
| 6,742,671 | B2 | 6/2004 | Hebron et al. | 221/9 |
| 6,772,907 | B2 * | 8/2004 | Kim | 221/131 |
| 6,786,946 | B2 * | 9/2004 | Jung | 55/302 |
| 6,805,175 | B1 * | 10/2004 | Pinkas et al. | 141/130 |
| 6,925,783 | B1 | 8/2005 | Pearson | 53/475 |
| 6,928,790 | B2 | 8/2005 | Takahashi et al. | 53/247 |
| 7,121,427 | B2 | 10/2006 | Guerra | 221/126 |
| 7,207,485 | B2 | 4/2007 | Silverbrook et al. | 235/385 |
| 7,249,688 | B2 | 7/2007 | Hunter et al. | 221/79 |
| 7,293,672 | B2 | 11/2007 | Mori et al. | 221/122 |
| 7,308,338 | B2 | 12/2007 | Guerra | 700/245 |
| 7,428,805 | B2 | 9/2008 | Kim | 53/131.4 |
| 7,549,266 | B2 | 6/2009 | Yuyama et al. | 53/281 |
| 7,555,875 | B2 | 7/2009 | Kim | 53/154 |
| 7,562,791 | B2 | 7/2009 | Yuyama et al. | 221/265 |
| 7,596,925 | B2 | 10/2009 | Yuyama et al. | 53/131.5 |
| 7,603,197 | B2 | 10/2009 | Yuyama et al. | 700/216 |
| 7,689,318 | B2 | 3/2010 | Draper | 700/236 |
| 2001/0002448 | A1 | 5/2001 | Wilson et al. | 700/233 |
| 2002/0095238 | A1 | 7/2002 | Ahlin et al. | 700/243 |
| 2003/0230590 | A1 | 12/2003 | Gilmore | 221/2 |
| 2004/0059463 | A1 | 3/2004 | Coughlin | 700/229 |
| 2004/0107022 | A1 | 6/2004 | Gomez | 700/231 |
| 2004/0261897 | A1 * | 12/2004 | Carlson et al. | 141/130 |
| 2006/0213816 | A1 | 9/2006 | Jorritsma | 209/576 |
| 2006/0259195 | A1 | 11/2006 | Eliuk et al. | 700/245 |
| 2006/0266188 | A1 | 11/2006 | Kim | 83/511 |
| 2006/0271237 | A1 | 11/2006 | Kim | 700/226 |
| 2007/0169838 | A1 | 7/2007 | Yuyama et al. | 141/107 |
| 2007/0186514 | A1 | 8/2007 | Vollm et al. | 53/473 |
| 2008/0164281 | A1 | 7/2008 | Yuyama et al. | 221/197 |

* cited by examiner

AUTOMATIC MEDICINE PACKING MACHINE WITH CLEANING DEVICE

CROSS REFERENCE TO RELATED APPLICATION

This application claims priority from and the benefit of Korean Patent Application No. 10-2008-0081681, filed on Aug. 21, 2008, which is hereby incorporated by reference for all purposes as if fully set forth herein.

BACKGROUND

1. Technical Field

The present invention relates to an automatic medicine packing machine for successively packing various medicines dose by dose, and more particularly, to an automatic medicine packing machine having a cleaning device for automatically cleaning dust generated in the packing machine while packing medicines.

2. Description of the Related Art

Conventionally, there have been developed and used automatic medicine packing machines that receive medicines from a plurality of cassettes containing various kinds of medicines such as tablets and capsules and then successively packing the medicines dose by dose.

FIG. 1 is a schematic longitudinal sectional view showing a conventional automatic medicine packing machine. Referring to FIG. 1, the conventional automatic medicine packing machine includes a body 10, a plurality of cassettes 20 arranged in an upper portion of the body 10 to receive medicines of various sizes and shapes such as tablets and capsules, a hopper 30 arranged in a lower portion of the body 10 to collect medicines that are discharged from the cassettes 20 and fall, a printer 40 for printing various kinds of information onto a surface of a packing paper in which medicines are packed, and a packing device 50 for packing the medicines collected by the hopper 30 in the packing paper.

In the conventional automatic medicine packing machine so configured, several tens to hundreds of kinds of medicines are received in the cassettes 20, and while these medicines are discharged and dropped, fine powder is generated due to the collision between the falling medicines and a surface of the hopper 30, so that different medicine components are mixed and collected in the hopper 30 or on a discharge passage.

Thus, when medicines are packed, minor amounts of a medicine component that is not intended to mix with or be deposited on another medicine for a particular patient may be mixed or carried together, which may be harmful to the patient and cause a pharmaceutical accident. Thus, each section of the automatic medicine packing machine is required to be cleaned at regular intervals while each section is checked by the naked eye.

However, in order to clean the hopper 30 and the discharge passage of medicine and the like, parts such as the hopper 30 must be disassembled from the body 10 and cleaned, and then, the disassembled parts must be assembled to the body 10 again after the cleaning work. Conventional devices have components that are configured such that the foregoing requires complicated and/or time-consuming disassembly, making the cleaning and inspecting very cumbersome, time-consuming, and costly.

In particular, in a large pharmacy where an automatic medicine packing machine is used often, the packing machine must stop more frequently, and then parts must be disassembled and cleaned, which is very inconvenient and deteriorates a packing efficiency.

The cleaning work for conventional automatic medicine packing machines is very cumbersome, and should be periodically executed for preventing any pharmaceutical accidents. Accordingly, with conventional machines, it is demanded to extend the period for a cleaning work of the automatic medicine packing machine as long as possible for user's convenience.

BRIEF SUMMARY

In one embodiment, an automatic medicine packing machine includes a cleaning device configured to vacuum and/or suck dust generated in the automatic medicine packing machine during a medicine packing process and discharge the dust out of the automatic medicine packing machine so as to clean the interior thereof.

According to an aspect, there is provided an automatic medicine packing machine for successively packing various kinds of medicines dose by dose, which includes a plurality of cassettes arranged in an upper portion of a body to receive medicines of various sizes and shapes; a hopper assembly arranged in a lower portion of the body to collect medicines discharged from the cassettes and falling; a hopper mounting unit configured to mount the hopper assembly to a lower portion of a frame of the body to be openable; a packing device configured to pack the medicines collected by the hopper assembly; and a hopper cleaning device configured to suck dust generated from the hopper assembly during a medicine packing process to clean an interior of the hopper assembly.

In one embodiment, the hopper assembly preferably includes an upper hopper disposed in the frame, a lower hopper moveably coupled with respect to the upper hopper and having an opening, and a mesh member detachably inserted in the lower hopper.

In one embodiment, the lower hopper preferably includes a suction hole formed in a sidewall thereof to suck dust, and a suction chamber formed around the lower hopper and air-tightly surrounding the suction hole.

In one embodiment, a fan configured to supply outside air into the suction chamber may be attached to one side of the suction chamber, and the hopper cleaning device may be connected to another side of the suction chamber through a connection pipe to suck the air supplied by the fan together with dust and then to discharge the supplied air and dust out of the suction chamber.

In one embodiment, the mesh member has a shape corresponding to an interior shape of the lower hopper to closely conform to an inner surface or geometry of the lower hopper, and the mesh member has a sieve shape having a plurality of through holes for allowing dust to pass therethrough. An inner surface of the lower hopper and edges of the mesh member are preferably rounded.

In one embodiment, the through hole formed in the mesh member preferably has a diameter of 0.3 to 0.8 mm.

The plurality of through holes of the mesh member are preferably formed adjacent to a suction hole formed in the lower hopper.

Preferably, in one embodiment, the hopper cleaning device includes a vacuum pump for generating a vacuum, a connection pipe for connecting the hopper assembly and the vacuum pump to suck dust, and a filter provided in an intermediate portion of the connection pipe to filter off the sucked dust.

Preferably, in one embodiment, the vacuum pump and the filter are separately installed to an outside of the automatic medicine packing machine, and if a plurality of automatic medicine packing machines are employed, the vacuum pump and the filter are connected to all of the automatic medicine packing machines. The connection pipe is preferably connected to a lower portion of the hopper assembly to suck dust.

Preferably, in one embodiment, the hopper mounting unit includes a support member supporting the hopper assembly and pivotably coupled to a lower surface of the frame to pivot on a pivotal axis, and a regulating member installed to the lower surface of the frame to regulate a rotating angle of the support member.

The hopper cleaning device may be connected to the suction chamber through a connection pipe to suck inside air together with dust, and the air sucked in the hopper cleaning device, with the dust filtered, may be discharged from the hopper cleaning device and returned to the suction chamber.

According to another aspect, an automatic medicine packing machine for successively packing various kinds of medicines dose by dose includes a body; a plurality of cassettes arranged in an upper portion of the body to receive medicines of various sizes and shapes; and a hopper arranged in a lower portion of the body to collect medicines discharged from the cassettes and falling, wherein a mesh member having a plurality of through holes is inserted into the hopper, and dust generated in the hopper passes through the mesh member and sucked by a hopper cleaning device, thereby cleaning an interior of the hopper.

Preferably, in one embodiment, the hopper includes a fan configured to supply outside air into the hopper, and the hopper cleaning device sucks the air supplied by the fan together with dust and then discharges the air and dust out of the hopper.

According to a further aspect, an automatic medicine packing machine for successively packing various kinds of medicines dose by dose includes a plurality of cassettes arranged in an upper portion of a body to receive medicines of various sizes and shapes; a hopper arranged in a lower portion of the body to collect medicines discharged from the cassettes and falling; a packing device configured to pack the medicines collected by the hopper; and a cleaning device configured to discharge dust generated in the automatic medicine packing machine during a medicine packing process, to the outside.

Preferably, in one embodiment, the cleaning device includes an upper duct coupled to an upper portion of the automatic medicine packing machine, a lower duct coupled to a lower portion of the automatic medicine packing machine, and a connection duct for connecting the upper and lower ducts to a vacuum generating device or apparatus to suck dust in the automatic medicine packing machine.

Preferably, in one embodiment, the cleaning device includes an intermediate duct configured to connect the upper duct and the lower duct, the connection duct connecting the intermediate duct and the vacuum generating device. The connection duct may connect the upper or lower duct and the vacuum generating device.

The upper duct preferably includes an upper inner duct having one or more upper suction holes for dust suction and arranged in the automatic medicine packing machine, and an upper outer duct communicating with the upper inner duct and arranged outside or externally with respect to the automatic medicine packing machine. Preferably, in one embodiment, the upper inner duct and the upper outer duct are connected to each other through two left and right points or laterally opposing openings or regions of a rear upper cover of the automatic medicine packing machine.

Preferably, in one embodiment, the upper inner duct extends in a substantially horizontal direction side to side at a rear lower end of the cassette, and the upper suction holes formed in the upper inner duct are formed in plural in a length direction of the upper inner duct at intervals.

In one embodiment, the lower duct preferably includes a lower inner duct arranged in the automatic medicine packing machine and having at least one lower suction hole for dust suction, and a lower outer duct in fluid communication with the lower inner duct and arranged outside or externally with respect to the automatic medicine packing machine.

Preferably, in one embodiment, the lower inner duct and the lower outer duct are connected to each other through two left and right points or laterally opposing openings or regions of a rear lower cover of the automatic medicine packing machine.

Preferably, in one embodiment, the lower inner duct is arranged such that the lower suction hole is located adjacent to a rear side of the hopper installed in the automatic medicine packing machine.

A filter configured to filter dust may be installed or positioned toward an upstream region of the vacuum generating device.

In one embodiment, the connection duct may extend from a plurality of automatic medicine packing machines to a common vacuum generating device or apparatus.

According to a still further aspect, an automatic medicine packing machine for successively packing various kinds of medicines dose by dose is provided, wherein the medicines are discharged from cassettes, the cassettes are arranged in an upper portion of a body to receive medicines of various sizes and shapes, and the automatic medicine packing machine includes a duct extending over an inside and an outside of the automatic medicine packing machine such that dust generated or collected in the automatic medicine packing machine during a medicine packing process is discharged out of the automatic medicine packing machine.

DETAILED DESCRIPTION

First, an automatic medicine packing machine having a cleaning device according to one embodiment will be described in detail with reference to FIGS. 2 to 8.

Figure 1:
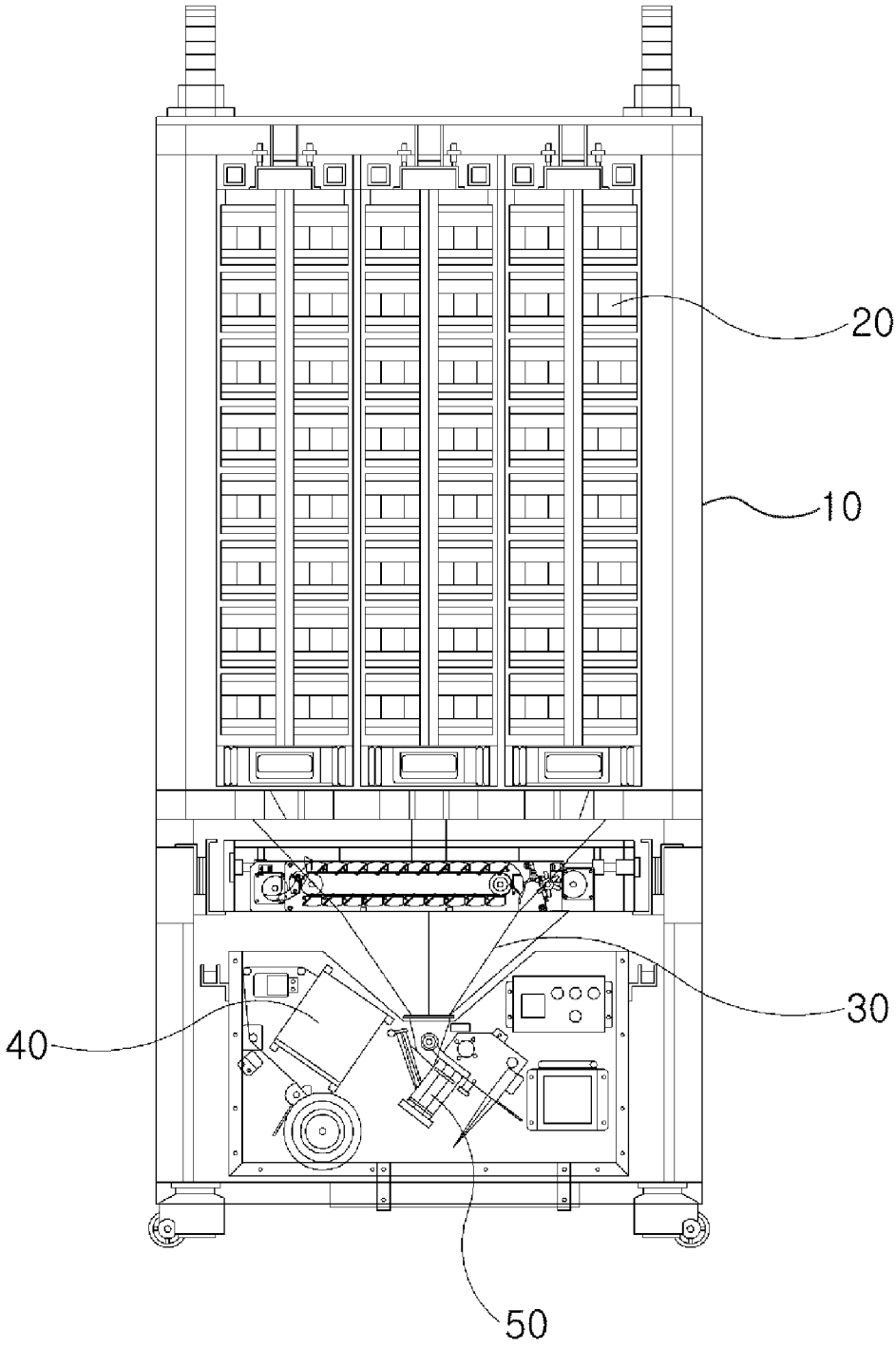
Prior Art Figure 1
FIG. 1 is a schematic front view showing a conventional automatic medicine packing machine.
Figure 2:
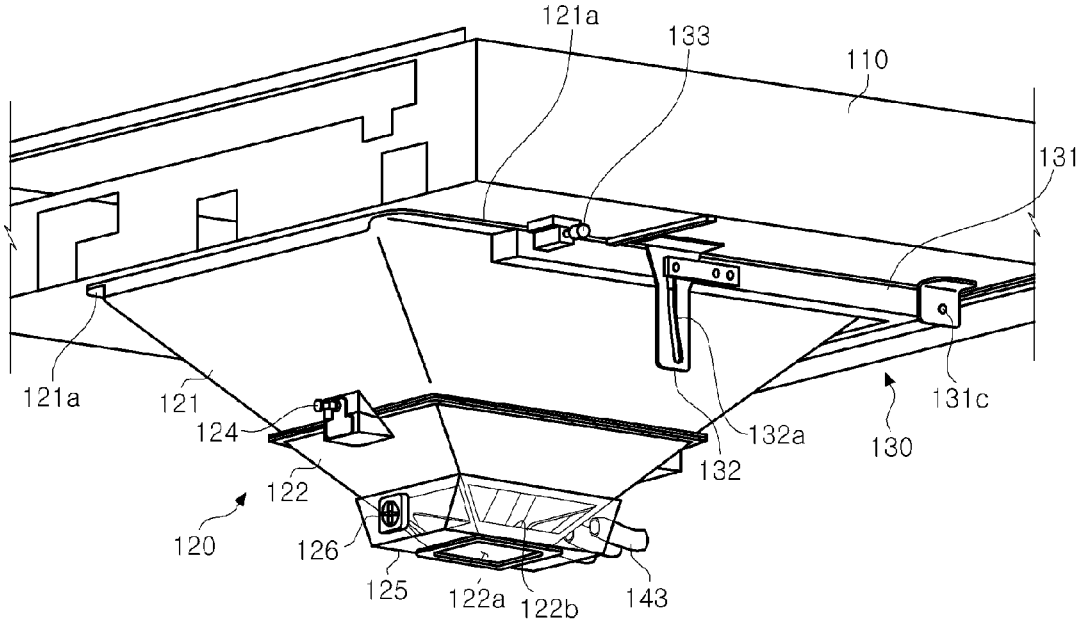
FIG. 2 is an isometric view of a hopper and a hopper cleaning device of an automatic medicine packing machine according to one embodiment.

The automatic medicine packing machine can include a body, a plurality of cassettes arranged in an upper portion of the body to receive medicines of various sizes and shapes such as tablets and capsules, a packing device arranged in a lower portion of the body to pack medicines that are discharged from the cassettes and fall, and a printer for printing various kinds of information onto a surface of a packing paper in which medicines are packed. The foregoing components can be substantially similar to the body 10, cassettes 20, packing device 50, and printer 40 illustrated in FIG. 1.

The automatic medicine packing machine further includes a hopper assembly 120 to collect medicines that are discharged from the cassettes and fall, a hopper mounting unit 130 for coupling the hopper assembly 120 to a lower side of a frame 110 in the body to be selectively moveable or openable, and a hopper cleaning device 140 for sucking dust generated or collected in the hopper assembly 120 to automatically clean the interior of the hopper assembly 120, as shown in FIGS. 2 to 5.

The plurality of cassettes can be arranged above the frame 110 to which the hopper assembly 120 is installed, so that medicines to be packed drop from the cassettes.

According to one embodiment, the hopper assembly 120 includes an upper hopper 121 disposed adjacent to the frame 110, a lower hopper 122 pivotably coupled to a lower side of the upper hopper 121 to be selectively openable, and a mesh member 123 (FIG. 6) detachably or removably inserted in the lower hopper 122. The lower hopper 122 may be coupled to the upper hopper 121 by a first coupling member 124 to be maintained in a closed state. The lower hopper 122 can be rotatably coupled at an end opposing the coupling member 122 such that when the coupling member 124 is released or unlocked, the lower hopper 122 can pivot away from the upper hopper 121.

Figure 4:
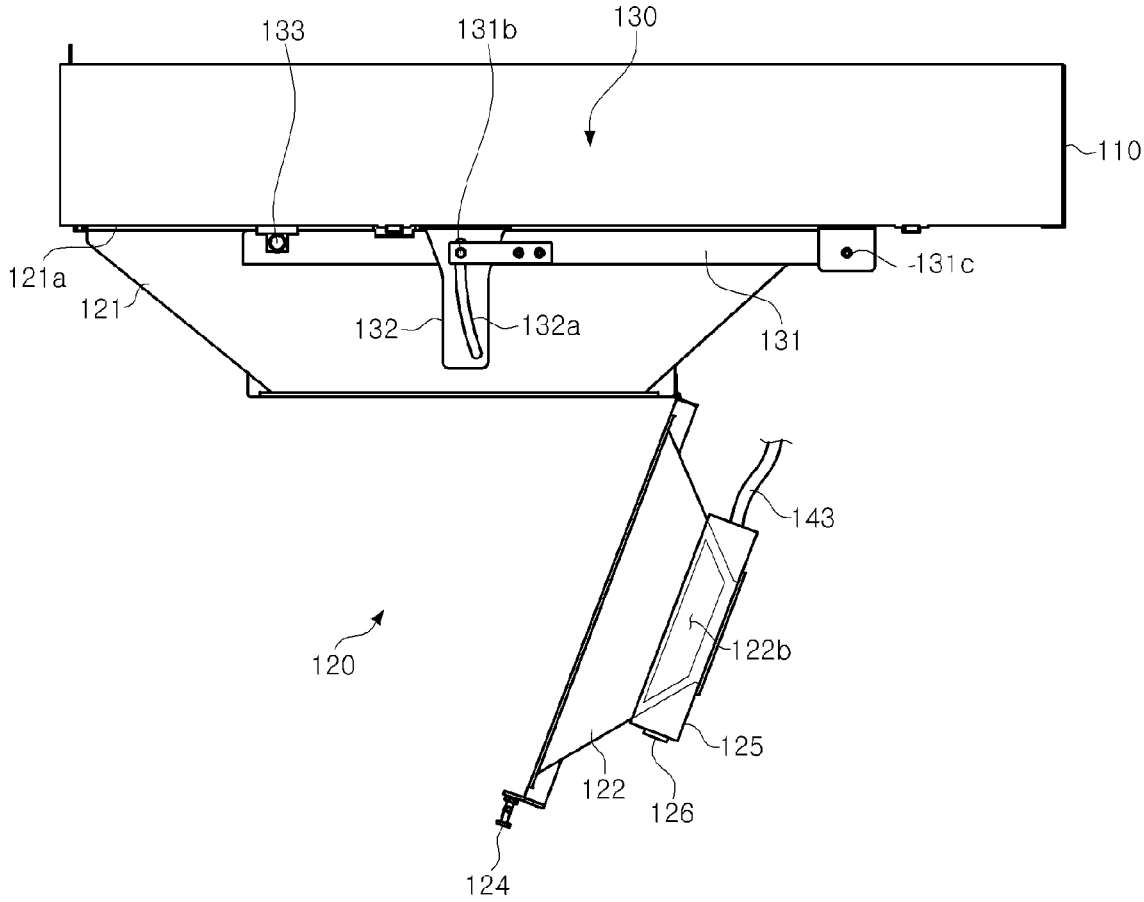
FIG. 4 is a side view of the hopper and the hopper cleaning device of FIG. 2, illustrating a lower portion of the hopper in an open state to facilitate separating a mesh member.
Figure 5:
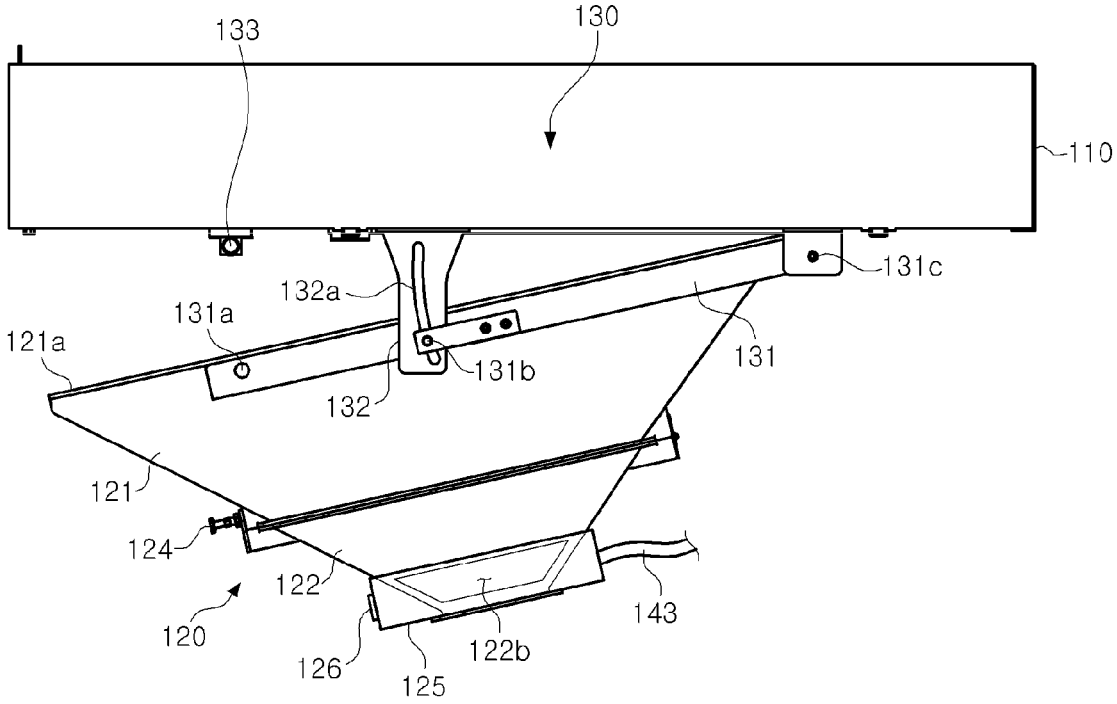
FIG. 5 is a side view of the hopper and the hopper cleaning device of FIG. 2, illustrating an upper portion of the hopper in an open state to facilitate separating or accessing the hopper.

For example, FIG. 4 shows that the lower hopper 122 is in an open state by releasing or unlocking the first coupling member 124. After the lower hopper 122 is open or pivoted as mentioned above, the mesh member 123 may be separated, and thus, it is possible to expediently clean the interiors of the mesh member 123 and the lower hopper 122 while checking them by naked eye without excess disassembly of the medicine packing machine.

Figure 3:
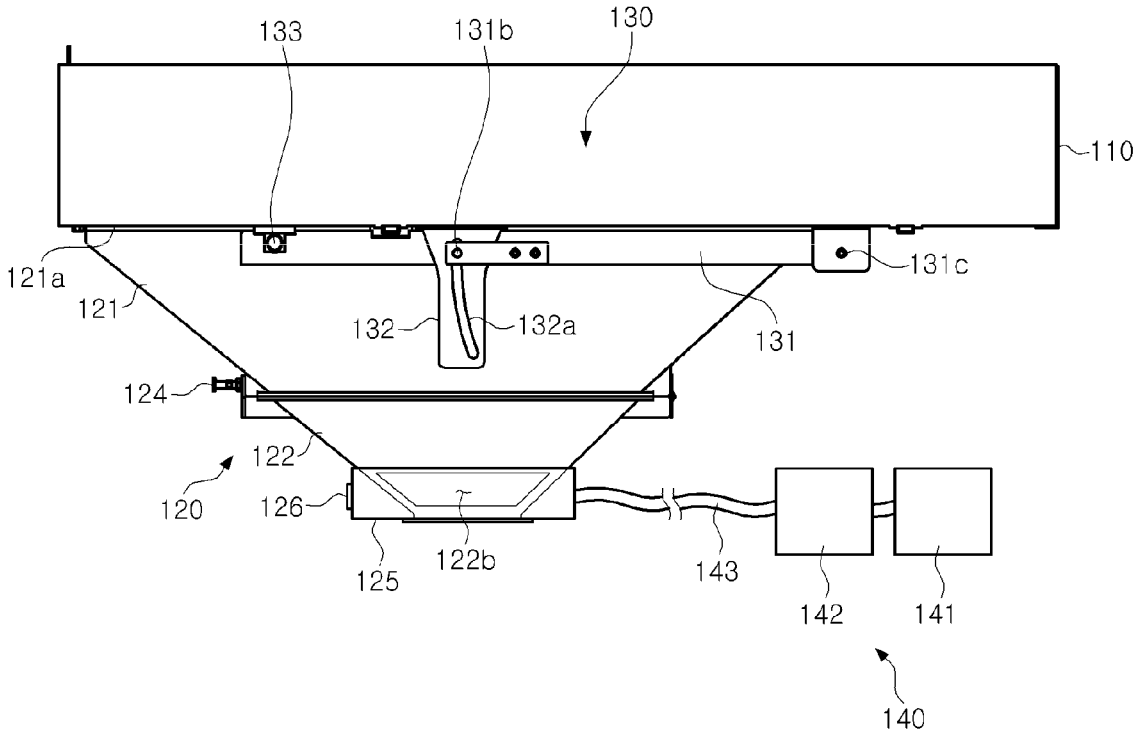
FIG. 3 is a side view of the hopper and the hopper cleaning device of FIG. 2.

Also, an opening 122*a* configured to transfer the collected medicines to the packing device is formed in a lower portion of the lower hopper 122, and suction holes 122*b* for sucking dust are formed in sidewalls of the lower hopper 122 around the opening 122*a*. It is preferable that these suction holes 122*b* are respectively formed in all four sidewalls of the lower hopper 122 and that the lower hopper 122 include a substantially inversed quadrangular pyramid shape. The suction hole 122*b* can be bored though the lower portion of the lower hopper 122 except for an edge region thereof, and accordingly, each suction hole 122*b* can have an inversed trapezoidal shape as shown in FIG. 3.

In one embodiment, a suction chamber 125 is formed around a lower portion of the lower hopper 122 having the suction holes 122*b* formed therein so as to airtightly surround the suction holes 122*b*. In one embodiment, a fan 126 configured to supply outside air into the suction chamber 125 is mounted or positioned to one side of the suction chamber 125, and a hopper cleaning device 140 for sucking air supplied by the fan 126 together with dust and discharging them out of the suction chamber 125 is connected to another side of the suction chamber 125. In one embodiment, the suction chamber 125 is preferably made of a transparent material such that its interior may be checked by naked eye during the cleaning process.

Figure 6:
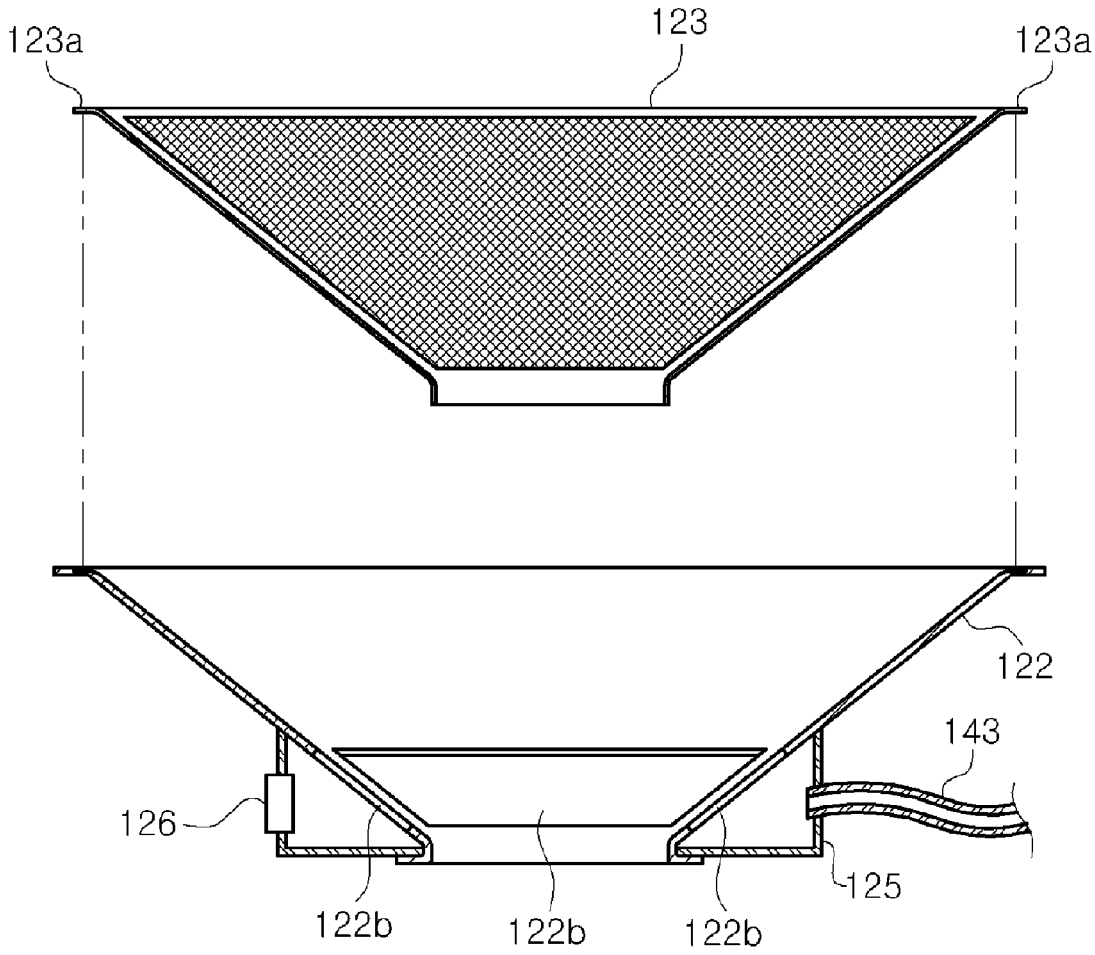
FIG. 6 is a side cross-sectional view of the hopper and the hopper cleaning device illustrating the lower hopper and the mesh member in a separated state.
Figure 7:
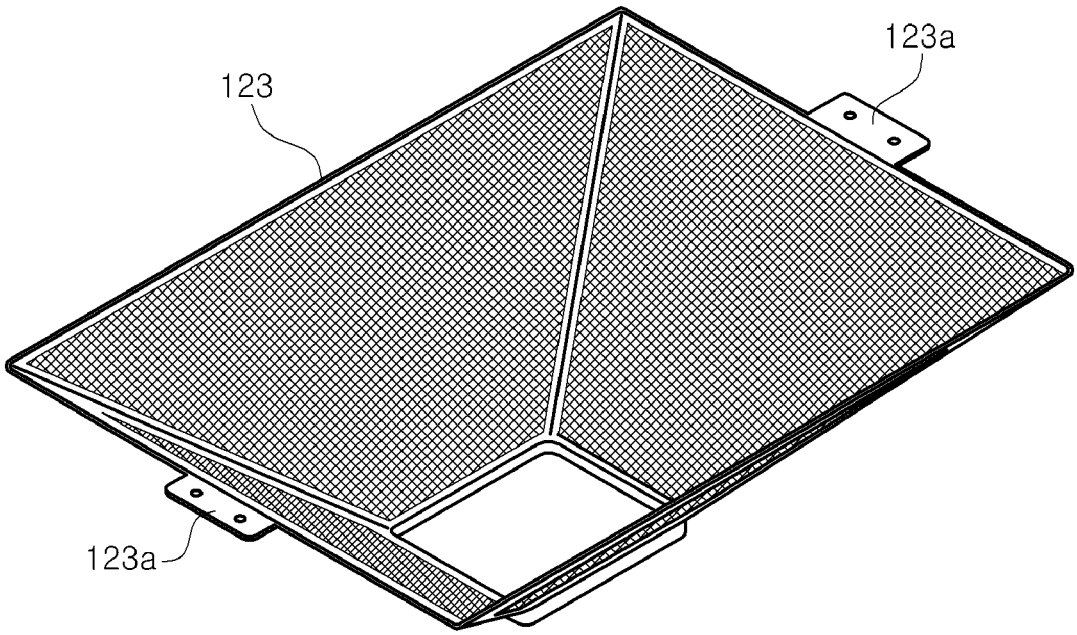
FIG. 7 is an isometric view of the mesh member of FIG. 6 according to one embodiment.

In one embodiment, the mesh member 123 has a shape corresponding to an interior shape of the lower hopper 122 so as to closely conform to the inside of the lower hopper 122, as shown in FIGS. 6 and 7. In one embodiment, the mesh member 123 has a sieve shape and includes through holes allowing fine dust to pass therethrough. Extensions 123*a* may be formed at an upper end of the mesh member 123 such that the mesh member may be easily positioned when being inserted into the lower hopper 122 and also easily gripped when being attached to or detached from the lower hopper 122.

In one embodiment, the inner surface of the lower hopper 122 and the edges of the mesh member 123 are preferably rounded. If the inner surface of the lower hopper 122 and the edges of the mesh member 123 are angled, while air is sucked by the hopper cleaning device 140, a vortex may be formed at the edge portion, inhibiting optimal suction and disposal of dust.

In one embodiment, the through holes formed in the mesh member 123 are sized so that dust passes through the through holes. In one aspect, the through holes have a diameter of about 0.3 to 0.8 mm. A diameter less than 0.3 mm may inhibit smooth removal of dust. If the through hole has a diameter greater than 0.8 mm, when medicines fall and collide with the portions in which the through holes are formed, the surface of the medicines may be prone to being scratched or cracked and the amount of generated dust increases.

Although it is illustrated in FIGS. 6 and 7 that fine through holes are formed in the entire surface of the mesh member 123 in a sieve shape, through holes may be formed only in a lower portion of the mesh member 123, for example a portion adjacent to the suction hole 122*b*, because dust is substantially collected on or around the lower end of the lower hopper 122, such as a portion where the suction hole 122*b* is formed.

In one embodiment as illustrated in FIGS. 1-5, the hopper mounting unit 130 includes a support member 131, which supports the hopper assembly 120 and is pivotably coupled to a lower surface of the frame 110 to pivot about a pivotal axis 131*c*, and a regulating member 132 coupled to the lower surface of the frame 110 to regulate a rotation angle of the support member 131 and facilitate selective control over pivoting the hopper assembly 120. The support member 131 is coupled to the frame 110 by a second coupling member 133 to maintain the support member 131 in a closed state.

The support member 131 is preferably shaped such that flanges 121*a* extending outward from the upper end of the upper hopper 121 are included on three surfaces of the support member 131. The pivotal axis 131*c* is positioned toward a first side of the support member 131 as mentioned above, and a coupling groove 131*a* (FIG. 5) to be coupled with the second coupling member 133 is formed toward an end of a second side of the support member 131, opposed to the first side and the pivotal axis 131*c*.

Although it is illustrated in FIGS. 2 to 5 that the second coupling member 133 is coupled to the lower surface of the frame 110 and the coupling groove 131*a* to be coupled with the second coupling member 133 is formed in the support member 131, in other embodiments, the second coupling member 133 can be coupled to the support member 131, and a coupling member such as the coupling groove 131*a* can be formed in the frame 110.

In one embodiment, an arc-shaped groove 132*a* is formed in the regulating member 132, and a protrusion 131*b* inserted into the arc-shaped groove 132*a* is formed on the support member 131. It is illustrated in FIG. 4 that the upper hopper 121 is in an open or pivoted state by releasing or unlocking the second coupling member 133. When the upper hopper 121 is open or pivoted away from the frame 110 and the support member 131 pivots about the pivotal axis 131*c*, the protrusion 131*b* is provided to move along the arc-shaped groove 132*a*, and accordingly, the protrusion 131*b* can move in the length of the arc-shaped groove 132*a*, facilitating regulating a rotating angle of the support member 131.

After the support member 131 pivots to the open state shown in FIG. 4, a user may access, separate, and/or move the entire hopper assembly 120 including the upper hopper 121 away from the support member 131. Since the hopper assembly 120 may be separated or moved at least partially away from the support member 131 as mentioned above, the user may easily clean the parts within the hopper assembly 120, such as the upper hopper 121, the lower hopper 122 and the like while checking them by naked eye without requiring complicated or time-consuming disassembly.

According to one embodiment as shown in FIG. 3, the hopper cleaning device 140 includes a vacuum pump 141 for generating a vacuum, a connection pipe 143 for connecting the suction chamber 125 of the lower hopper 122 and the vacuum pump 141 to suck the air in the suction chamber 125, and a filter 142 provided in an intermediate portion of the connection pipe 143 to filter off the sucked medicine dust.

In one embodiment, the vacuum pump 141 and the filter 142 may be separately installed or coupled to outside or externally with respect to the automatic medicine packing machine. In case of a large pharmacy in which more than one automatic medicine packing machine are employed, one vacuum pump 141 and one filter 142 may be connected to all of the automatic medicine packing machines.

Dust typically collects in the vicinity of the lower end of the hopper assembly 120, so that the suction chamber 125 is formed in the lower end of the hopper assembly 120 (e.g., a lower portion of the lower hopper 122). Accordingly, in one aspect, the connection pipe 143 can be connected to the lower portion of the hopper assembly 120 to suck air.

The vacuum pump 141 may periodically or intermittently operate by a controller (not shown), or continuously operated while the automatic medicine packing machine operates.

Also, a single pipe may be used as the connection pipe 143 connected to one side of the suction chamber 125. Alternatively, a branched connection pipe or a plurality of connection pipes may be respectively attached to a plurality of spots of the suction chamber 125. According to one embodiment, the fan 126 is installed to a side of the suction chamber 125 opposite to the connection pipe 143, thereby supplying outside air, so that dust even in the side opposite to the connection pipe 143 may be effectively sucked out.

Figure 8:
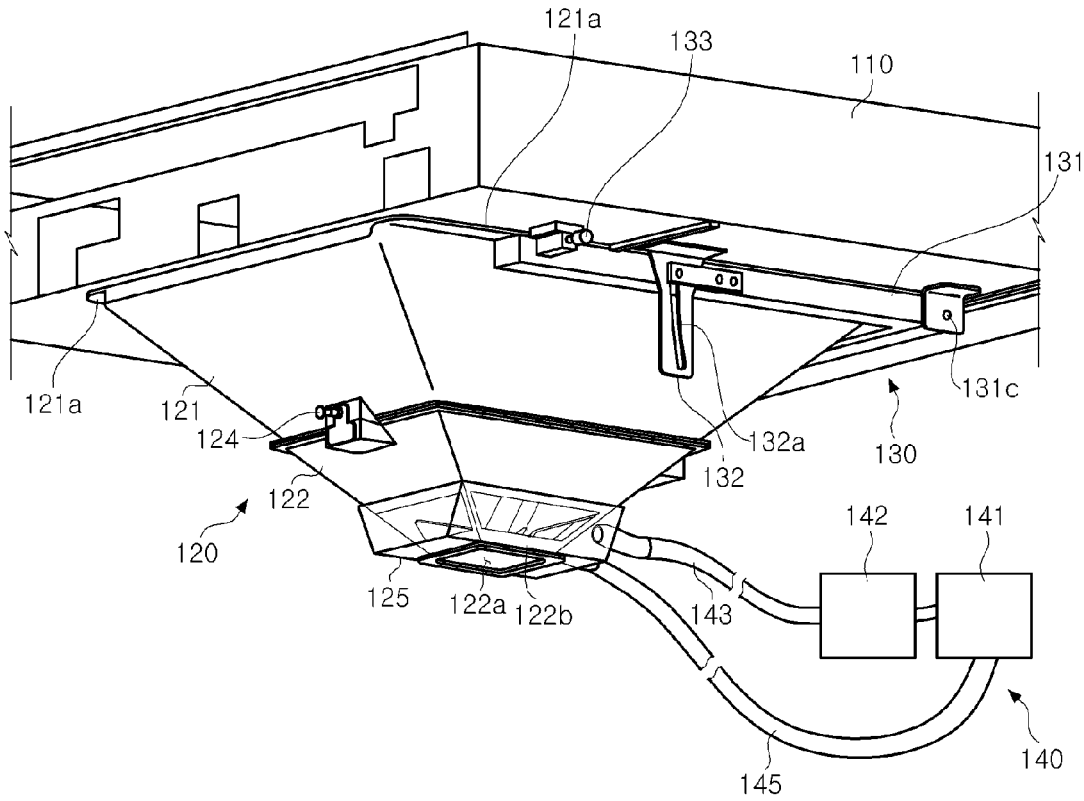
FIG. 8 is an isometric view of a hopper and a hopper cleaning device of an automatic medicine packing machine according to one embodiment.
Figure 9:
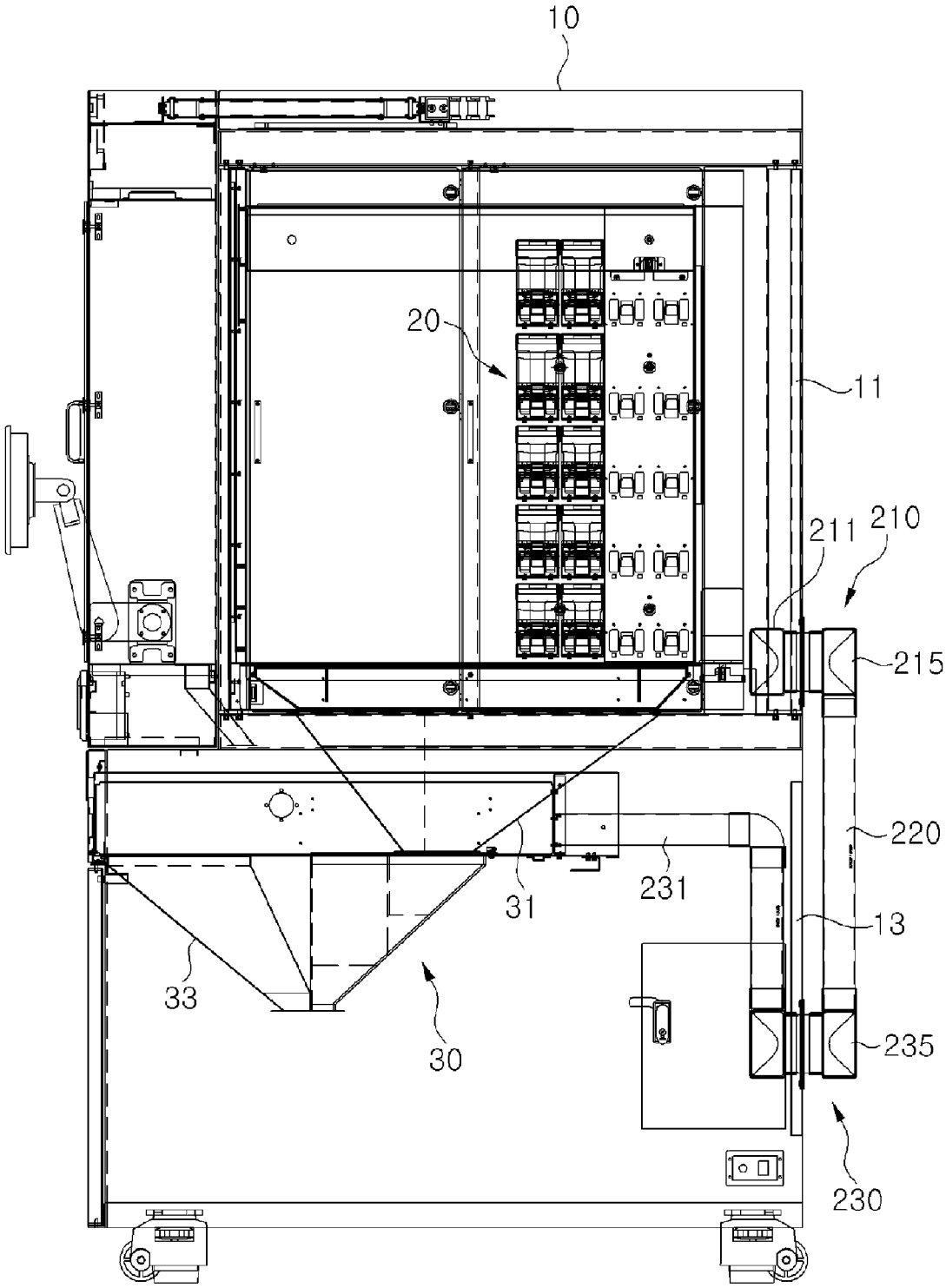
FIG. 9 is a side view of an automatic medicine packing machine having a cleaning device according to one embodiment.

In addition, according to one embodiment, instead of installing the fan to the suction chamber 125, the hopper cleaning device 140 may be provided such that the air sucked in the vacuum pump 141 through the connection pipe 143 and the filter 142 from the suction chamber 125 and then discharged from the vacuum pump 141 may return to the suction chamber 125 through an air supply pipe 145, to prevent introduction of dust to outside air, as shown in FIG. 8.

According to this embodiment, partitions (not shown) are suitably arranged in the suction chamber 125 so that the air supplied from the air supply pipe 145 is not directly sucked into the connection pipe 143 but preferably is sucked into the connection pipe 143 after circulating in the suction chamber 125.

The automatic medicine packing machine having the hopper cleaning device 140 installed thereto according to this modification does not need a duct structure for air and dust discharged out of the automatic medicine packing machine, so that it is suitable for a small pharmacy in which an automatic medicine packing machine or small number thereof are employed.

Hereinafter, an automatic medicine packing machine according to another embodiment will be described with reference to FIGS. 9 to 14.

The automatic medicine packing machine includes a cleaning device for sucking dust generated in the automatic medicine packing machine during a medicine packing process using vacuum and then discharging the dust out of the automatic medicine packing machine.

Figure 12:
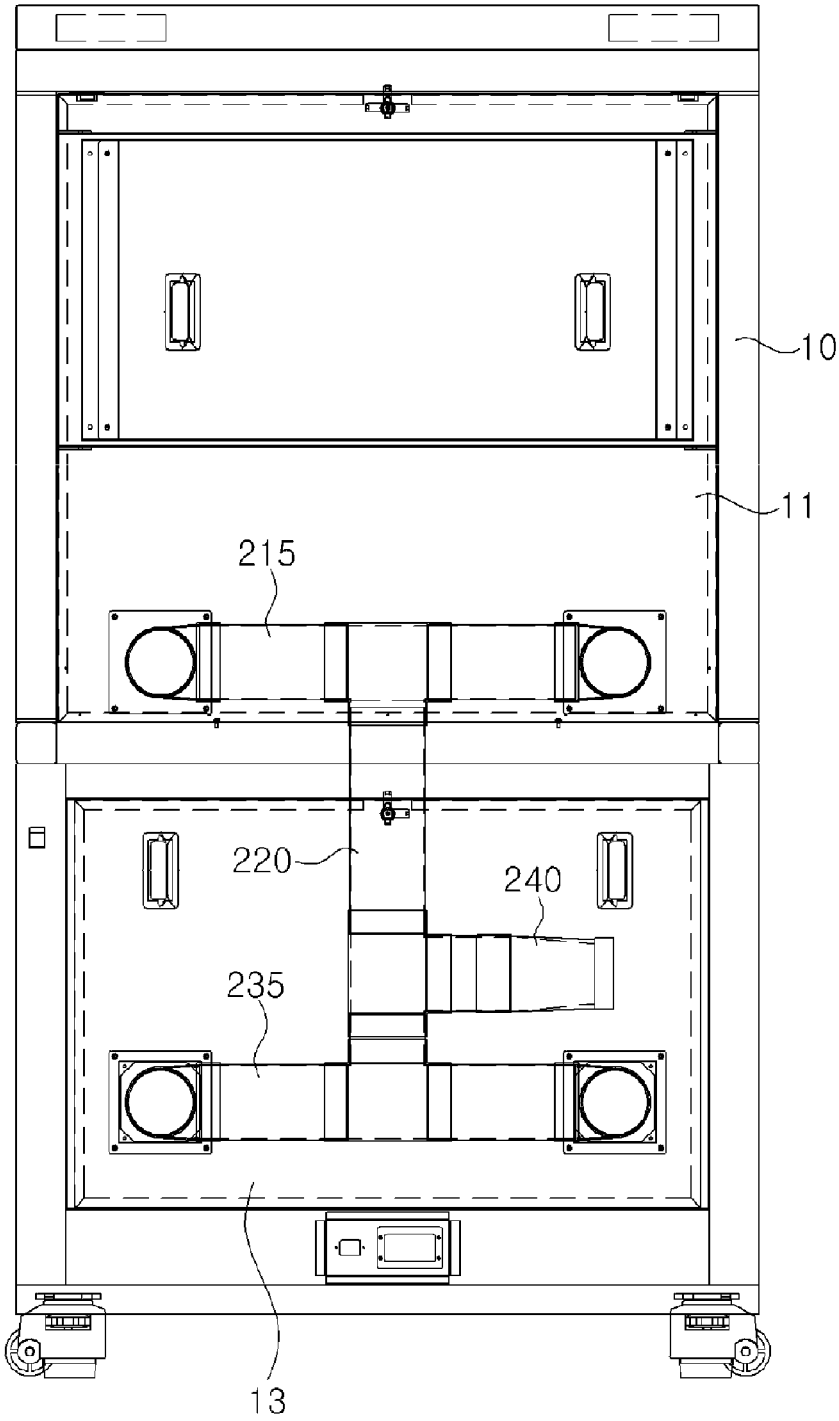
FIG. 12 is a rear view of a cleaning device mounted to an automatic medicine packing machine according to one embodiment.
Figure 13:
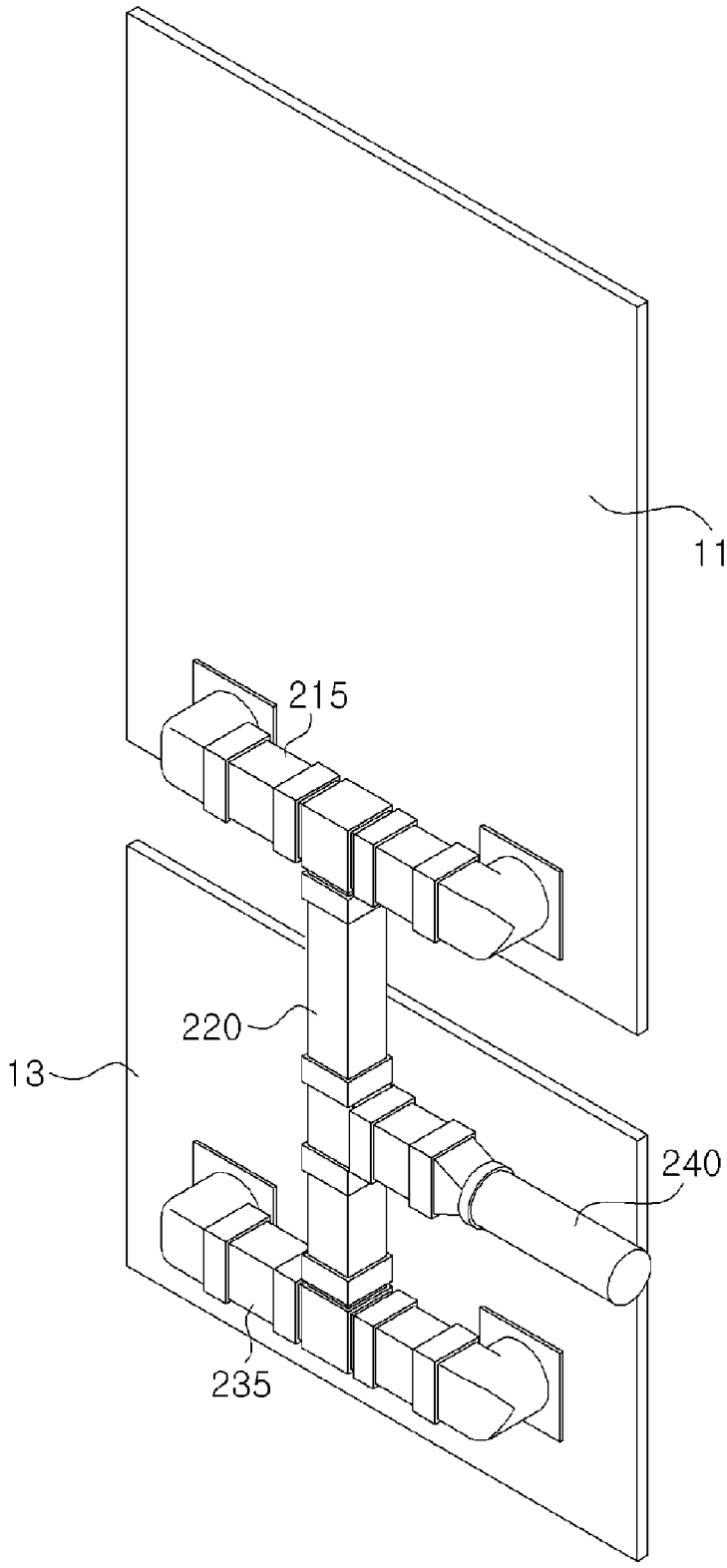
FIG. 13 is a rear isometric view of the cleaning device of FIG. 12.
Figure 14:
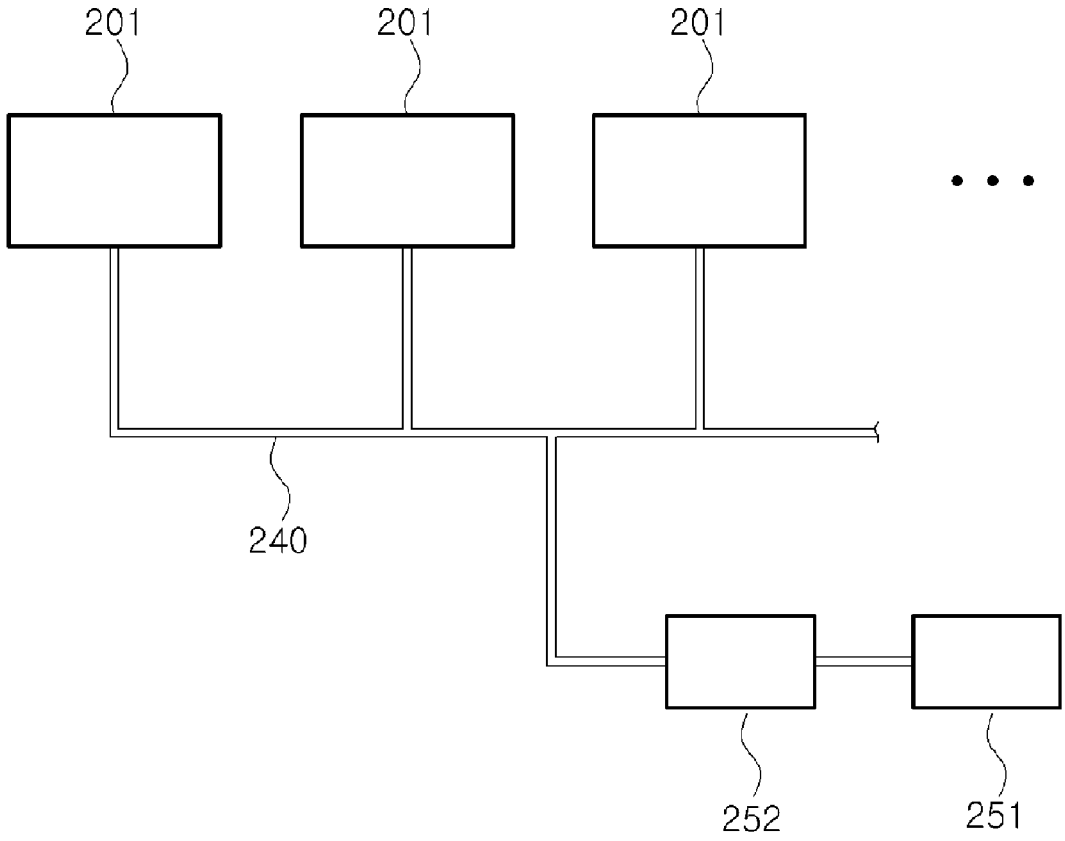
FIG. 14 is a schematic diagram illustrating a cleaning device according to one embodiment configured to be used with a plurality of automatic medicine packing machines.

As shown in FIGS. 9 to 13, the automatic medicine packing machine includes a body 10, a plurality of cassettes 20, a hopper 30, and the cleaning device includes an upper duct 210 installed in an upper portion of the automatic medicine packing machine, a lower duct 230 installed in a lower portion of the automatic medicine packing machine, an intermediate duct 220 for connecting the upper duct 210 to the lower duct 230, and a connection duct 240 for connecting the intermediate duct 220 to a vacuum generating device or apparatus (e.g., a vacuum pump 251) (FIG. 14).

The aforementioned cassettes 20 can be arranged in the upper portion of the automatic medicine packing machine. The upper duct 210 includes an upper inner duct 211 arranged in the automatic medicine packing machine and having one or more upper suction holes 213 formed in a rear lower side of the plurality of cassettes, and an upper outer duct 215 in fluid communication with the upper inner duct 211 and arranged outside or externally with respect to the automatic medicine packing machine.

As shown in FIGS. 9 to 13, according to one embodiment, the upper inner duct 211 and the upper outer duct 215 fluidly communicate with each other through a rear upper cover 11 of the automatic medicine packing machine and pass through the rear upper cover 11 at two points in left and right sides or at laterally opposing regions or openings in the rear upper cover 11.

Figure 10:
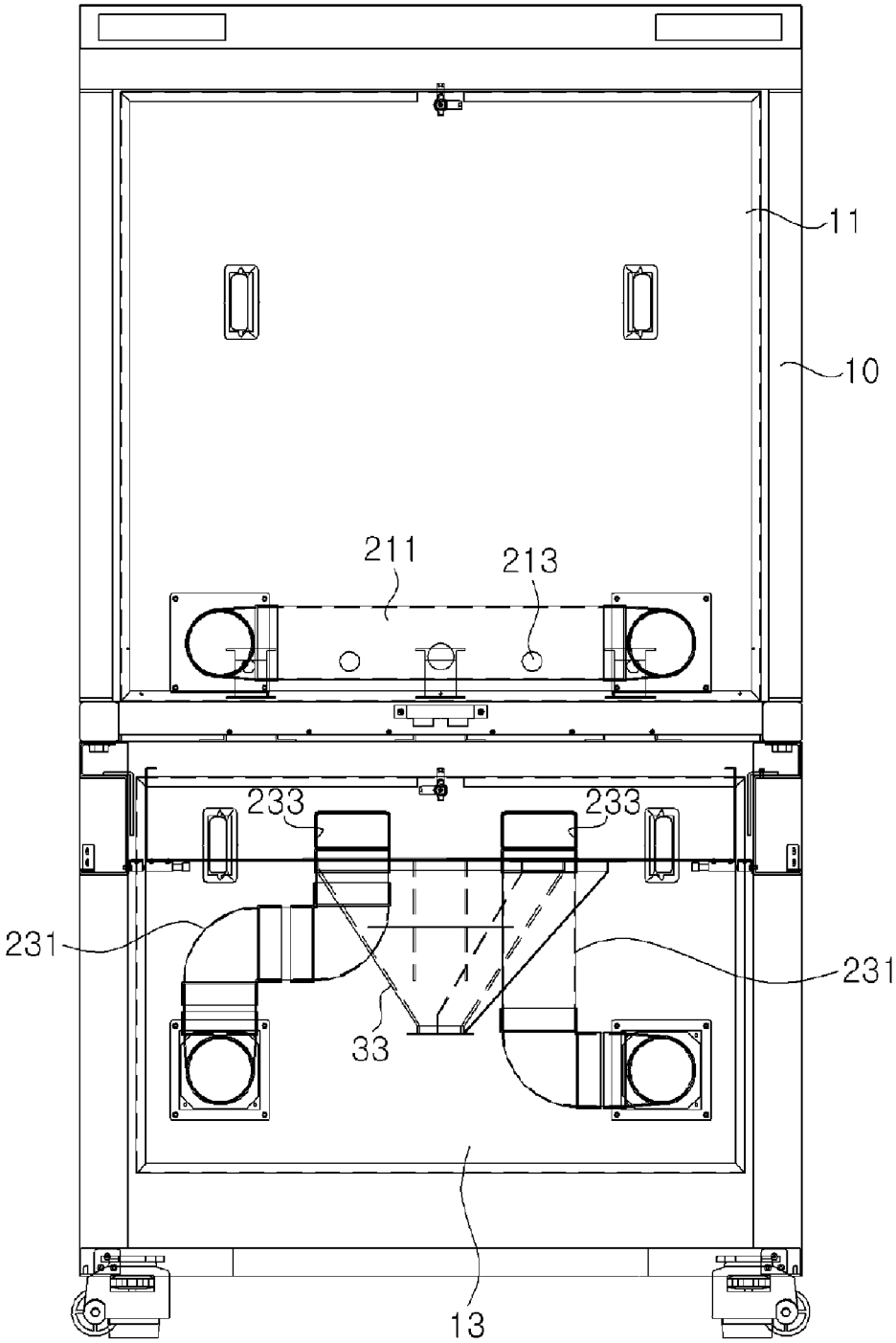
FIG. 10 is a front view of a cleaning device mounted to an automatic medicine packing machine according to one embodiment.
Figure 11:
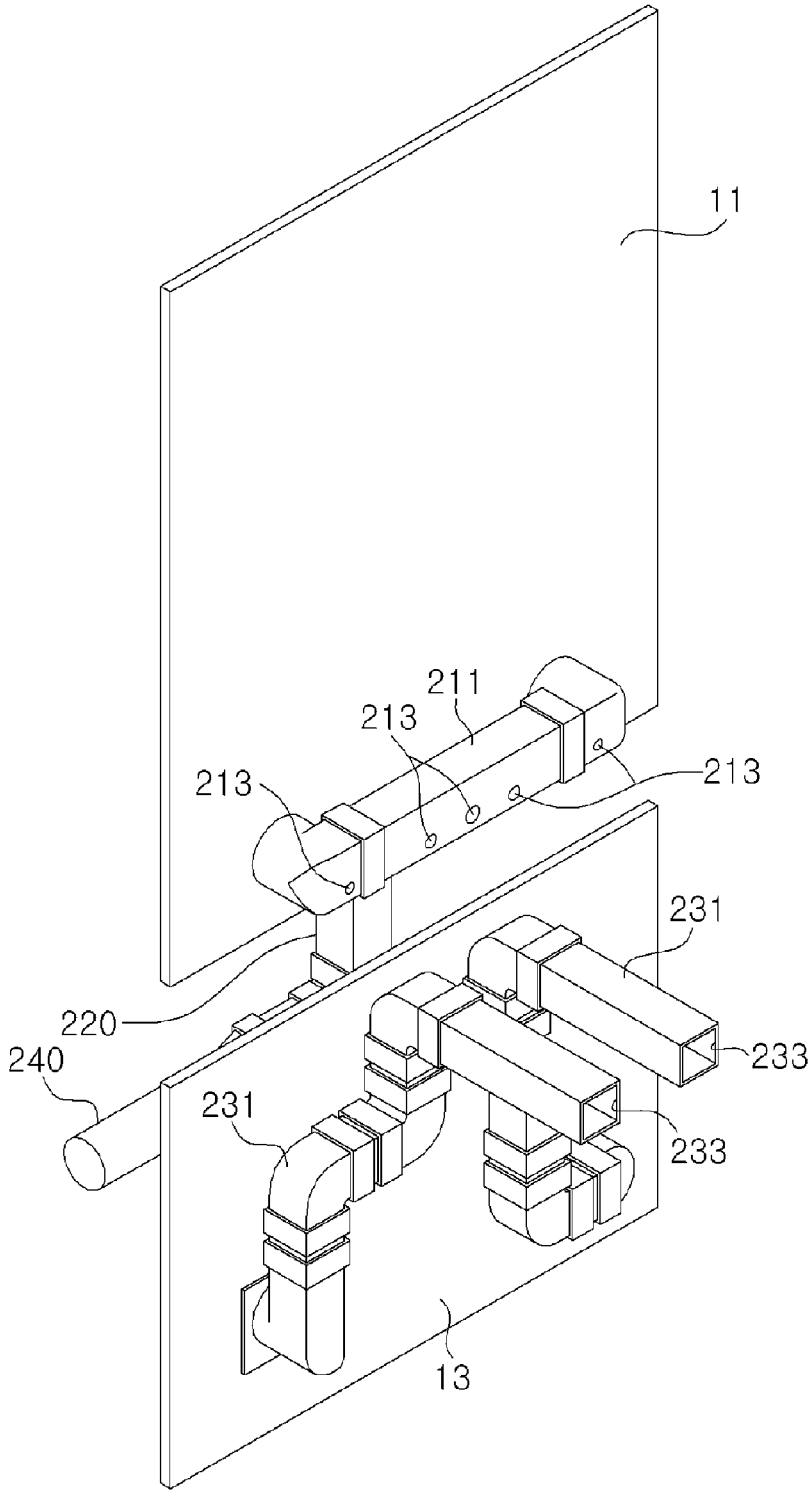
FIG. 11 is a front isometric view of the cleaning device of FIG. 10.

In one embodiment, the upper inner duct 211 has the one or more upper suction holes 213 for sucking dust provided in the upper portion of the automatic medicine packing machine. The upper inner duct 211 is disposed to extend in a substantially horizontal direction side to side at the rear lower ends of the cassettes. In one embodiment as illustrated in FIGS. 10 and 11, the upper suction holes 213 are formed in plural in the upper inner duct 211 at regular intervals along a length direction of the upper inner duct 211.

The upper suction holes 213 suck dust generated when medicines are discharged from the hopper 30, particularly from an upper portion of an upper hopper 31, and then allows the dust to be discharged out of the automatic medicine packing machine through the duct device.

The lower duct 230 includes lower inner ducts 231 coupled to or arranged in the automatic medicine packing machine and each having at least one lower suction hole 233 formed in or in fluid communication with a rear side of the hopper 30, and a lower outer duct 235 in fluid communication with the lower inner ducts 231 and arranged outside or externally with respect to the automatic medicine packing machine.

As shown in FIGS. 9 to 13, according to one embodiment, the lower inner ducts 231 and the lower outer duct 235 communicate with each other through a rear lower cover 13 of the automatic medicine packing machine and pass through the rear lower cover 13 at two points in left and right sides or at laterally opposing regions or openings in the rear lower cover 13.

In one embodiment, the lower inner duct 231 has at least one lower suction hole 233 for sucking dust provided in the lower portion of the automatic medicine packing machine. The lower inner duct 231 can be disposed such that the lower suction hole 233 is located in a rear side of the hopper 30, for example between the upper hopper 31 and the lower hopper 33.

As mentioned above, according to one embodiment, the upper inner duct 211 and the lower inner ducts 231 are formed such that the upper suction holes 213 and the lower suction holes 233 are located at most suitable positions for dust suction.

In one embodiment, the upper inner duct 211 is configured or positioned such that the upper suction holes 213 are located at a lower end of the rear side of the cassettes 20 arranged in the automatic medicine packing machine, e.g., in the rear side between the hopper 30 and the cassettes 20. The lower inner duct 231 can be configured such that the lower suction hole 233 is located at a most suitable position for dust suction without interference with a variety of parts installed in the automatic medicine packing machine, e.g., adjacent to the rear side between the upper hopper 31 and the lower hopper 33.

The upper inner duct 211 and the lower inner ducts 231 may have various shapes if the upper suction holes 213 and the lower suction holes 233 may suck dust in a suitable manner, and they are not limited to the arrangements shown in FIGS. 9 to 13. Also, as shown in FIGS. 10 and 11, left and right ones of the lower inner ducts 231 may be different in shape. In addition, the number, location and size of the upper suction holes 213 and the lower suction holes 233 may be modified in various suitable ways.

In one embodiment, the intermediate duct 220 connects the upper outer duct 215 and the lower outer duct 235 at the outside of the automatic medicine packing machine. Although it is illustrated in FIGS. 12 and 13 that the intermediate duct 220 connects a central portion of the upper outer duct 215 and a central portion of the lower outer duct 235, the connection points of the intermediate duct 220 may be offset toward a right or left side in other embodiments.

In addition, the connection duct 240 may be divided into two parts and respectively connected to the upper outer duct 215 and the lower outer duct 235, without using the intermediate duct 220.

In one embodiment, the connection duct 240 is connected to the intermediate duct 220 and extends to the vacuum generating device or apparatus. As the vacuum generating device, any suitable device may be employed if it is operable to generate a vacuum to suck dust in the automatic medicine packing machine, such as a vacuum pump 251 (FIG. 7). As shown in FIG. 14, a filter 252 to filter dust is preferably installed to the upstream of the vacuum pump 251.

Although it is illustrated in FIGS. 12 and 13 that the connection duct 240 is connected to the intermediate duct 220, the connection duct 240 can in other embodiments be connected to the upper duct 210 or the lower duct 230.

FIG. 14 illustrates one embodiment in which a plurality of automatic medicine packing machines can be used in one location. Each automatic medicine packing machine 201 is provided with the cleaning device according to an embodiment of the present invention, and the connection duct 240 extends from each automatic medicine packing machine 201 to a commonly used vacuum pump 251. The connection duct 240 may be installed, mounted, or positioned on or to the ceiling of a building or other suitable structure.

Where a plurality of the automatic medicine packing machines 201 are used, an individual vacuum pump may be connected to each automatic medicine packing machine 201 instead of connecting all of the automatic medicine packing machines to the common vacuum pump 251.

When connecting each automatic medicine packing machine 201 to the common vacuum pump 251 using the connection duct 240, the arrangement of the connection duct 240 may be modified in various ways depending on the arrangement of the automatic medicine packing machines 201.

According to the present disclosure, there is provided an automatic medicine packing machine having a cleaning device capable of discharging dust generated in the automatic medicine packing machine during a medicine packing process to the outside so as to clean the interior of the automatic medicine packing machine. Dust generated in the hopper is not piled up in the automatic medicine packing machine but discharged out of the automatic medicine packing machine by vacuum, so that it is possible to decrease an amount of dust piled up in the automatic medicine packing machine.

Accordingly, the period for a user to separate and clean each part of the automatic medicine packing machine is extended, thereby ensuring more convenient use of the automatic medicine packing machine and enhancing an operation rate thereof and therefore a medicine packing efficiency.

The automatic medicine packing machine having a cleaning device according to an embodiment of the present invention has been described with reference to the accompanying drawings. However, the scope of the present invention is not limited to the aforementioned embodiments and the drawings. It will be apparent that those skilled in the art can make various modifications and changes thereto within the scope of the invention defined by the claims.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An automatic medicine packing machine comprising:

a body having a frame;

a plurality of cassettes arranged toward an upper portion of the body and configured to receive medicines;

a hopper assembly arranged toward a lower portion of the body and configured to collect medicines discharged from the cassettes, the hopper assembly including an upper hopper disposed in the frame and a lower hopper moveably coupled to the upper hopper, and the lower hopper including a suction hole formed in a sidewall thereof to suck dust, and a suction chamber formed around the lower hopper and airtightly surrounding the suction hole;

a hopper mounting unit configured to mount the hopper assembly to a lower portion of the frame of the body;

a packing device configured to pack the medicines collected by the hopper assembly; and a hopper cleaning device configured to vacuum dust from the hopper assembly to clean an interior of the hopper assembly.

2. The automatic medicine packing machine as claimed in claim 1, further comprising:

a fan configured to supply outside air into the suction chamber mounted toward a first side of the suction chamber; and a connecting pipe coupling the hopper cleaning device to a second side of the suction chamber to suck the air supplied by the fan together with dust and discharge the supplied air and dust out of the suction chamber.

3. The automatic medicine packing machine as claimed in claim 1, wherein the hopper cleaning device includes a vacuum device in fluid communication with the suction chamber, and a filtering member in fluid communication with the vacuum device and configured to filter sucked air and dust, substantially removing the dust to produce filtered air, the hopper cleaning device being connected to the suction chamber through a return connection pipe to return the filtered air to the suction chamber.

4. An automatic medicine packing machine comprising:

a body having a frame;

a plurality of cassettes arranged toward an upper portion of the body and configured to receive medicines;

a hopper assembly arranged toward a lower portion of the body and configured to collect medicines discharged from the cassettes, the hopper assembly including an upper hopper disposed in the frame, a lower hopper moveably coupled to the upper hopper, and a mesh member detachably inserted in the lower hopper, wherein the mesh member has a shape corresponding to an interior shape of the lower hopper, closely conforming to an inner surface of the lower hopper, the mesh member including a sieve shape having a plurality of through holes configured to permit dust to pass therethrough;

a hopper mounting unit configured to mount the hopper assembly to a lower portion of the frame of the body;

a packing device configured to pack the medicines collected by the hopper assembly; and a hopper cleaning device configured to vacuum dust from the hopper assembly to clean an interior of the hopper assembly.

5. The automatic medicine packing machine as claimed in claim 4, wherein the plurality of through holes of the mesh member are formed adjacent to a suction hole formed in the lower hopper.

6. An automatic medicine packing machine comprising:

a body having a frame;

a plurality of cassettes arranged toward an upper portion of the body and configured to receive medicines;

a hopper assembly arranged toward a lower portion of the body and configured to collect medicines discharged from the cassettes;

a hopper mounting unit configured to mount the hopper assembly to a lower portion of the frame of the body;

a packing device configured to pack the medicines collected by the hopper assembly; and a hopper cleaning device configured to vacuum dust from the hopper assembly to clean an interior of the hopper assembly, wherein the hopper cleaning device includes a vacuum pump configured to generate a vacuum, a connection pipe connecting the hopper assembly and the vacuum pump to suck dust, and a filter provided in an intermediate portion of the connection pipe to filter the sucked dust, and wherein the vacuum pump and the filter are separately installed outside of or externally with respect to the automatic medicine packing machine.

7. An automatic medicine packing machine comprising:

a body having a frame;

a plurality of cassettes arranged toward an upper portion of the body and configured to receive medicines;

a hopper assembly arranged toward a lower portion of the body and configured to collect medicines discharged from the cassettes;

a hopper mounting unit configured to mount the hopper assembly to a lower portion of the frame of the body;

a packing device configured to pack the medicines collected by the hopper assembly; and a hopper cleaning device configured to vacuum dust from the hopper assembly to clean an interior of the hopper assembly, wherein the hopper cleaning device includes a vacuum pump configured to generate a vacuum and a connection pipe connecting the hopper assembly and the vacuum pump to suck dust, and wherein the connection pipe is connected to a lower portion of the hopper assembly to suck dust.

8. An automatic medicine packing machine comprising:

a body having a frame;

a plurality of cassettes arranged toward an upper portion of the body and configured to receive medicines;

a hopper assembly arranged toward a lower portion of the body and configured to collect medicines discharged from the cassettes;

a hopper mounting unit configured to mount the hopper assembly to a lower portion of the frame of the body wherein the hopper mounting unit includes a support member supporting the hopper assembly and pivotably coupled to a lower region of the frame to pivot about a pivot axis, and a regulating member coupled to the lower region of the frame and configured to regulate a rotating angle of the support member;

a packing device configured to pack the medicines collected by the hopper assembly; and a hopper cleaning device configured to vacuum dust from the hopper assembly to clean an interior of the hopper assembly.

9. An automatic medicine packing machine comprising:

a body;

a plurality of cassettes arranged toward an upper portion of the body to receive medicines;

a hopper arranged toward a lower portion of the body to collect medicines discharged from the cassettes;

a packing device configured to pack the medicines collected by the hopper; and a cleaning device receiving and discharging dust generated in the automatic medicine packing machine to an external environment or space, the cleaning device including an upper duct coupled to an upper portion of the automatic medicine packing machine, a lower duct coupled to a lower portion of the automatic medicine packing machine, and a connection duct connecting the upper and lower ducts to a vacuum generating device to suck dust from the automatic medicine packing machine.

10. The automatic medicine packing machine as claimed in claim 9, wherein the cleaning device includes an intermediate duct connecting the upper duct and the lower duct, and the connection duct connects the vacuum generating device and at least one of the intermediate duct, the upper duct and the lower duct.

11. The automatic medicine packing machine as claimed in claim 9, wherein the upper duct includes an upper inner duct having one or more upper suction holes and arranged in the automatic medicine packing machine, and an upper outer duct in fluid communication with the upper inner duct and arranged outside of or externally with respect to the automatic medicine packing machine.

12. The automatic medicine packing machine as claimed in claim 11, further comprising:

an upper cover, wherein the upper inner duct and the upper outer duct are connected to each other through laterally opposing openings in the upper cover, and wherein the upper inner duct extends in a substantially horizontal direction at a rear lower end of the cassettes, the upper suction holes formed in the upper inner duct being formed along a length of the upper inner duct at intervals.

13. The automatic medicine packing machine as claimed in claim 9, wherein the lower duct includes a lower inner duct arranged in the automatic medicine packing machine and having at least one lower suction hole, and a lower outer duct in fluid communication with the lower inner duct and arranged outside of the automatic medicine packing machine.

14. The automatic medicine packing machine as claimed in claim 13, further comprising:

a lower cover, wherein the lower inner duct and the lower outer duct are connected to each other through laterally opposing openings in the lower cover, and wherein the lower inner duct is arranged such that the lower suction hole is located adjacent to a side of the hopper.

15. The automatic medicine packing machine as claimed in claim 9, further comprising:

a filtering member configured to substantially filter dust and coupled to the vacuum generating device.

16. The automatic medicine packing machine as claimed in claim 9, wherein the connection duct extends from a plurality of automatic medicine packing machines to a common vacuum generating device.

17. A hopper assembly configured to be used with an automatic medicine packing machine, the hopper assembly comprising:

an upper hopper member configured to be coupled to the automatic medicine packing machine;

a lower hopper member pivotably coupled to the upper hopper member and including a suction hole formed in a sidewall thereof to suck dust, and a suction chamber formed around the lower hopper and sealingly surrounding the suction hole;

a mesh member detachably inserted in the lower hopper;

a vacuum generating device in fluid communication with the suction chamber; and a hopper mounting unit including a support member and a regulating member, the support member coupled to the upper hopper member and configured to be pivotably coupled to the automatic medicine packing machine toward a first end of the support member, the regulating member configured to be fixedly connected to the automatic medicine packing machine, the support member being slidably coupled to the regulating member toward a second end of the support member, the regulating member regulating a rotating angle of the support member via limiting the sliding range of the second end of the support member.

* * * * *